US007290371B2

(12) United States Patent
Zimmerman

(10) Patent No.: US 7,290,371 B2
(45) Date of Patent: Nov. 6, 2007

(54) COMBINED SECURITY STRUT APPARATUS AND THRESHOLD COVER FOR SLIDING DOORS AND WINDOWS

(76) Inventor: Jack Zimmerman, 1562 W. Laramie Ave., Rathdrum, ID (US) 83858

( * ) Notice: Subject to any disclaimer, the term of this patent is extended or adjusted under 35 U.S.C. 154(b) by 296 days.

(21) Appl. No.: 10/855,939

(22) Filed: May 26, 2004

(65) Prior Publication Data

US 2005/0262772 A1 Dec. 1, 2005

(51) Int. Cl.
*E05B 1/00* (2006.01)

(52) U.S. Cl. ..... 49/460; 49/467; 52/211; 52/DIG. 12

(58) Field of Classification Search ..... 49/460, 49/449, 404, 456, 467, 468, 469, 471; 52/207, 52/204.51, 211, DIG. 12; 16/82; 292/346, 292/288, 289, DIG. 15, DIG. 46
See application file for complete search history.

(56) References Cited

U.S. PATENT DOCUMENTS

| | | | | |
|---|---|---|---|---|
| 3,360,887 | A * | 1/1968 | Parks et al. | 49/490.1 |
| 3,554,592 | A * | 1/1971 | Katz | 292/263 |
| 3,816,967 | A | 6/1974 | Littrell | 49/449 |
| 3,820,285 | A * | 6/1974 | Shiffler et al. | 49/450 |
| 4,073,522 | A | 2/1978 | Tierney | 292/262 |
| 4,798,407 | A | 1/1989 | Miller | 292/229 |
| 4,993,761 | A | 2/1991 | Paskert | 292/288 |
| 5,469,666 | A * | 11/1995 | Lewis, Jr. | 49/471 |
| 6,070,918 | A | 6/2000 | Calvache, Jr. | 292/46 |
| 6,230,385 | B1 * | 5/2001 | Nelson | 29/450 |
| D543,287 | S * | 5/2007 | Neuhofer, Jr. | D25/136 |
| 2003/0154678 | A1 * | 8/2003 | Stanchfield | 52/468 |

* cited by examiner

*Primary Examiner*—Jerry Redman

(57) ABSTRACT

A locking strut for use on sliding doors, windows and other sliding closures. The locking strut is supplementary to any closure lock. The strut has at least one receiver in the bottom surface to receive one or more guide rails included in the guide channel of the casement. The apparatus also preferably includes a hold or holds that allow easier insertion and handling. One strut may be used in the casement both when the sliding door is in the open position and the closed position. This is allowed by having one end received in the casement upright in a first orientation for a first slider position. The other end does not fit within the casement in a second slider position. This allows the strut to serve as both a supplementary locking device and as a threshold cover to exclude debris from the guide channel when the slider is open.

6 Claims, 6 Drawing Sheets

COMBINED SECURITY STRUT APPARATUS AND THRESHOLD COVER FOR SLIDING DOORS AND WINDOWS

TECHNICAL FIELD

The invention relates to supplemental security devices for sliding doors, sliding windows and other sliding closures having the combined ability to lock the closure and be fitted into the guide channel to serve as a cover and/or for storage.

BACKGROUND OF THE INVENTION

It is commonly known that so-called sliding doors, such as sliding glass or window doors, are relatively easily displaced and removed from the outside of a building or room. This is true even though the door may be locked. This has led to many burglaries where access to a home, business or other location has been surreptitiously made by a burglar using a removable sliding door or other closure.

It has been previously known to cut a piece of wood to the desired length of the space between the moving sash and the casement that forms the surrounding framework of the closure. Such pieces serve to form a locking device. Such wooden locking devices are inserted between the closed sliding door sash and the casement of the door assembly. This is helpful in that the known methods for easy displacement and removal of the sliding door are much more difficult or impossible without breaking the glass and removing the wooden strut locking device.

Although such supplementary wooden strut locking devices are commonly used, they lack ascetic appeal and are often a slight embarassment for the homeowner. They also have no features which make storage convenient for the supplementary locking device and they serve no other purpose.

These limitations are greater problems when the door is in frequent use between open and a double-locked condition (wherein both the regular door lock and the supplementary strut lock) are both desirably used and engaged. Thus, it is typical for the security strut to be stood in the corner or next to the door for ready use when the property owner is ready to leave the premises and again seeks to fully secure the structure.

Thus, there remains a long-felt need in this technical art for an improved, economical, easy-to-use and ascetically pleasing device and related methods which help in securing sliding doors, windows and similar closures against forced entry by burglars.

BRIEF DESCRIPTION OF THE DRAWINGS

Preferred embodiments of the invention are described below with reference to the following accompanying drawings.

DETAILED DESCRIPTION OF THE PREFERRED EMBODIMENTS

Introductory Note

Figure 1:
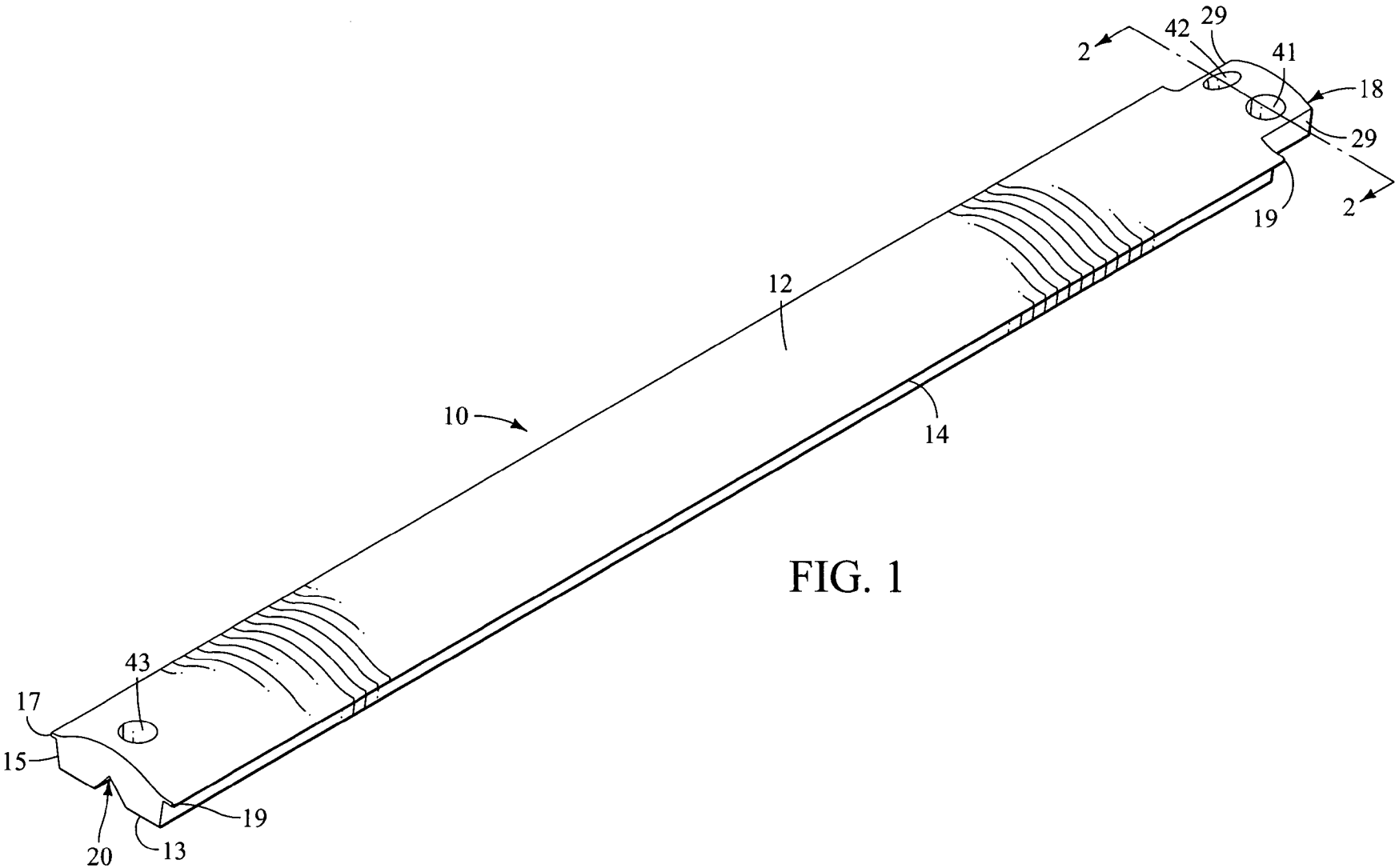
FIG. 1 is a perspective view showing a first locking device according to the invention.

The readers of this document should understand that the embodiments described herein may rely on terminology used in any section of this document and other terms readily apparent from the drawings and language common therefor. This document is premised upon using one or more terms with one embodiment that will in general apply to other embodiments for similar structures, functions, features and aspects of the invention. Wording used in the claims is also descriptive of the invention and is incorporated by reference as written below into this detailed description. Terminology used with one, some, or all embodiments may be used for describing and defining the technology and exclusive rights associated herewith.

Some Forms of the Inventions Generally

In some forms of the inventions the device and methods involve a locking or security strut apparatus which is shaped and sized to fit the guide of a sliding door, window or similar sliding closure. This can most advantageously be done in a form of a combined security strut and guide cover which allows the strut device to be placed on both sides of the slider door or other sliding sash, depending on the condition desired by the user.

In some preferred forms of the invention the security strut is also preferably made of a material or materials that match or simulate the casement of the door, window or other closure being secured. For example, many modern sliding doors are made with the sash being formed of a plastic, such as a synthetic polymer material, for example: polyvinyl chloride and other suitable materials. In some of the preferred versions of the inventions the security strut is made of a matching material to provide very substantially improved ascetics.

The matching materials of the security strut can be of the same material type, appearance, color, surface texture or other attributes as the sliding sash with which it is being used. Such characteristics provide consistent appearance which is of substantial consideration to homeowners who purchase these goods and who may also purchase the accompanying devices made according to the inventions.

Another desirable aspect of the more preferred forms of the invention is the provision of a suitable hold or holds that provide for the installation, movement, and removal of the security strut from either: a locking position between the sliding sash and casement framework which prevents opening of the sliding sash; or a stowage position in which the strut is positioned and stored in the sliding sash guide when the door, window, or other closure is in the open or closed position.

In some forms of the invention the sliding closure strut may be constructed so as to form both a combined sliding closure locking apparatus and a cover to prevent dirt and debris from easily collecting in the casement bottom sliding sash guide. For example, where the strut is for a sliding door, then the strut may be constructed to serve as a combined security strut and threshold cover. In both functions the device is placed in the casement bottom guide channel which receives a sliding glass door, or other casement constraining the sash or sashes used for the closure. This dual use as both a security strut and a guide channel cover also has the advantage of providing a suitable and useful storage or stowage for the security strut, thus eliminating the well-known problem of what to do with the prior art devices when they are not in a securing or locking position. This dual use also keeps dirt and other debris from accumulating in the guide from foot traffic or other cause.

Sliding Closure Security Strut

FIG. 1 shows one preferred device or apparatus according to one form of the invention. The device is a sliding closure security strut apparatus 10. Sliding closure strut 10 may typically be for a door closure or for a window closure. Strut 10 has a top surface 12, bottom surface 13, a first side or inside surface 14, and second or medial side surface 15. Strut 10 also has a first end 18 and an opposing second end 17.

Top Surface of Strut

The top surface 12 is shown in a preferred configuration wherein the top surface is crowned or arched. This helps to prevent tripping and strengthens the columnar strength of the strut when serving as a secondary security lock. It further helps to keep dirt and debris off of the device. Still further, it helps to keep dirt and other debris from getting into and accumulating in the casement guide track for the sliding door or window. It is alternatively possible to use a flat or nearly flat top surface in alternative constructions according to the invention.

The top surface 12 is also provided with at least one hold or handling features that allow a user to grasp and remove or replace the security strut. As shown, security strut 10 is provided with several types of handling features. In one form, the handling feature is provided as dual, proximate holes 42 and 43. The two or more proximate holes are sized to allow entry of a user's fingers thereinto. By using plural holes a person can pinch or grasp the strut to handle it as needed to remove, install or reposition the strut.

FIG. 1 also shows another form of hold or handling feature in the form of a single hole or aperture 43. Single hold aperture 43 may be used at both ends or upon a singular end of the strut. It may be desirable for a number of reasons to have a single hole at one end, both ends, or in a combination at one end together with a dual or multiple holes or other holds and handling feature or features at or near the opposing ends. The handling features 41-43 which form receptacles are advantageously placed near the ends of the security strut to reduce the accumulation of dirt and other debris therein, particularly when serving as a combined security apparatus and as a door threshold cover over which people walk with shoes that will at times have dirty soles.

Figure 2:
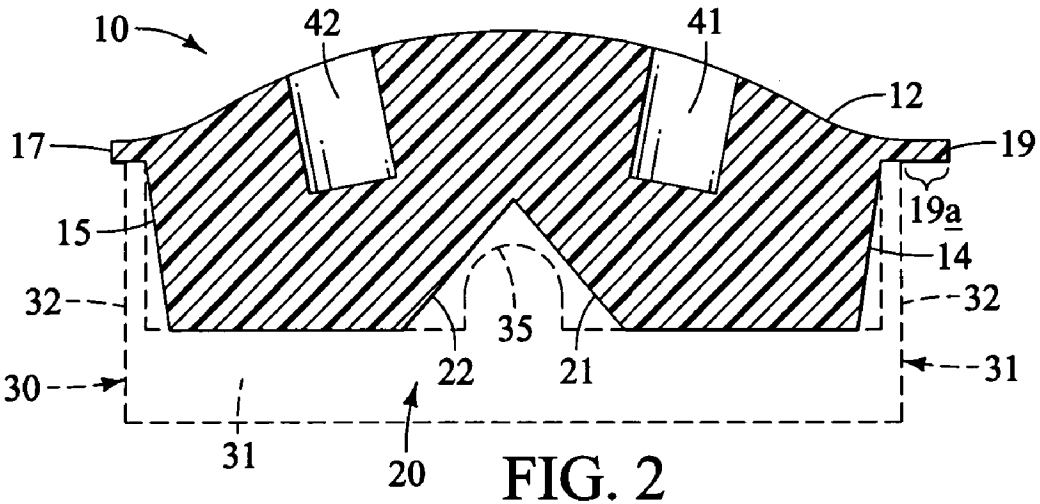
FIG. 2 is a cross-sectional view taken along line 2-2 of FIG. 1 showing the locking device of FIG. 1 positioned within the casement guide channel (shown in phantom or hidden line).

FIG. 2 also shows another type of hold or handling feature in the form of a projecting lip 19. Projecting lip 19 runs along most of the length of strut 10 as FIG. 1 shows. Projecting lip 19 has an overhang 19*a* which allows a user to grasp or place a finger under to lift or otherwise manipulate or maneuver the interior edge of the strut.

FIGS. 1 and 2 show several different types of holds which can be used together, in various combinations or each singularly on the apparatuses according to this invention.

Figure 3:
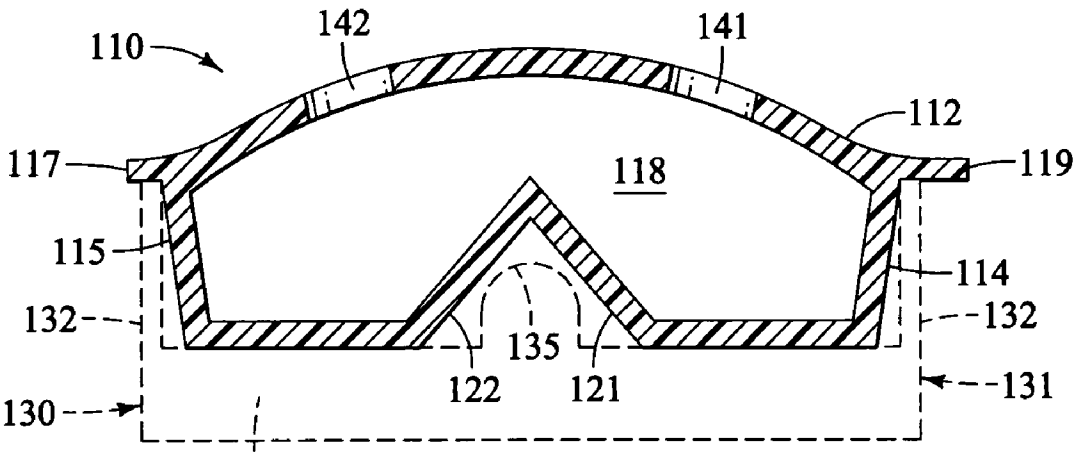
FIG. 3 is a cross-sectional view similar to FIG. 2 analogous to being taken along line 2-2 of FIG. 1 with a hollow construction, of an alternative embodiment wherein the locking device is a hollow strut also illustrated as positioned within a casement guide channel shown in hidden line.

Embodiment of FIG. 3

FIG. 3 shows a security strut 110 similar in many features to security strut 10. Many of the same features are labeled using reference numerals which are similar to those shown in FIG. 2 except the numeral has been changed to a 100 series numeral, such as 110 instead of 10 (as used in FIG. 2). Thus repeating the description is not needed, since such device incorporates the description given above. The notable differences between struts 10 and 110 will now be described.

The primary difference between the first embodiment 10 and second embodiment 110 is that strut 10 has a solid core whereas embodiment 110 has a hollow core having an internal cavity 118. This may be preferred where a stronger material of construction is used to reduce materials consumption or merely to lighten the structure to save materials costs.

Casement and Sashes

FIG. 2 shows the security apparatus and movable sash are directed and steered using a guide 31 which is advantageously channel shaped. In typical installations, casement frame 210 (FIGS. 4 and 5) is provided with at least one guide rail 35 (FIG. 2) or other feature along the upwardly facing bottom piece of the casement frame. The guide typically includes at least one guide rail centrally placed between inside and outside guide walls 32.

It may alternatively be possible to provide the frame with a plurality of guide features, such as a plurality of guide rails similar to rail 35 (not illustrated) which are typically parallel. Other guide features may also be used if appropriately shaped and sized to engage with the bottom of the moving sash 201. If multiple guide rails are used, then the strut 10 would use multiple receivers 20 (FIG. 1) not specifically illustrated.

In some forms of door and window frames there are also lateral supports, such as in the form of guide side surfaces 32 (FIG. 2). Such lateral guide features may also be used, if appropriately shaped and sized, to engage with or otherwise guide the bottom of the moving sash frame 203 and serve to help in supporting the sliding sash against displacement from the desired slide path of the slidable or moving sash assembly 201 (see FIG. 4).

The central guide rail typically is used with a set of sash rollers 213 (FIG. 4) mounted upon the bottom of the moving or sliding sash 201. The guide rollers typically have concave cross-sectional outer peripheries (not shown) that fit over or otherwise complement the rail 35 or other suitable casement guide features. The typical concave cross-sectional rim shape of such rollers also serves to keep the sliding or rolling sash in alignment upon the rails of the casement bottom guide system.

Guide rollers 213 and others that are typically used on the sliding sashes are usually spring-loaded. This spring loaded mounting of the guide rollers makes the sliding sash more susceptible to displacement and entry by a burglar.

Sides of Strut Apparatus

The embodiments of FIGS. 2 and 3 show a security strut apparatus having side walls 14, 114 and 15, 115 that are upright and can taper toward the bottom of the apparatus. The width of the security strut is sized to fit the apparatus within and advantageously against the casement bottom guide. Although the sidewalls may be tapered, alternative configurations may also be suitable.

Ends of Strut Apparatus

Figure 8:
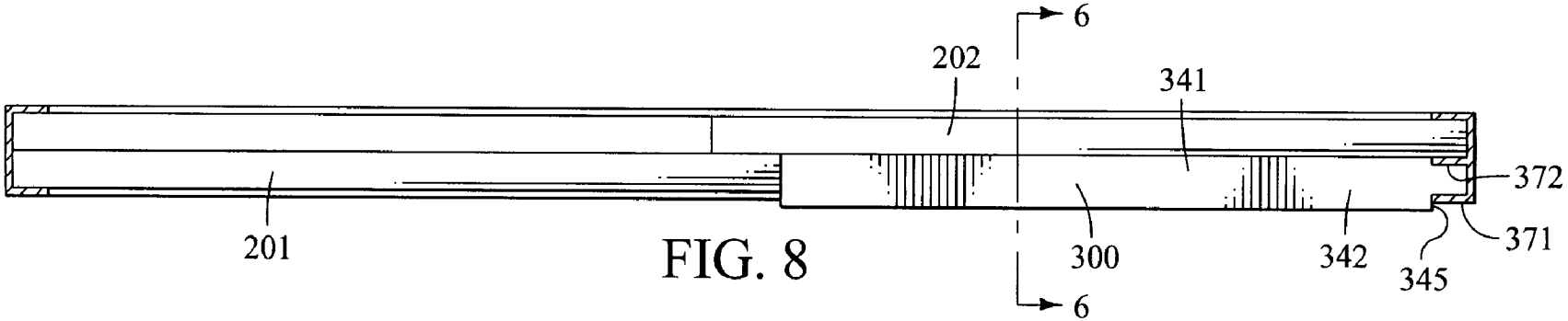
FIG. 8 is a top diagrammatic view showing a sliding door assembly with the movable sash 201 in a closed position locked in place by the security strut of FIG. 6.

FIG. 1 shows that the first end 18 has cutout portions 29 that provide a smaller size to the strut at the first end 18. The second end 17 does not have similar cutout portions 29. The smaller size and/or some other configurational features of the first end allows the first end to fit at a longitudinally extended position within the upright casement 371 as illustrated in the diagram of FIG. 8. This is provided so that the struts 10, 110 and 300 may be positioned between the closed movable sash 201 in FIG. 8, such as by being received into the pocket or channel 372 of the upright casement piece. This shortens the effective length from the shoulders 345 of the strut to the second end of the strut. This accommodates the shorter distance between the right edge of sash 201 in FIG. 8 up to the casement upright 371.

Figure 9:
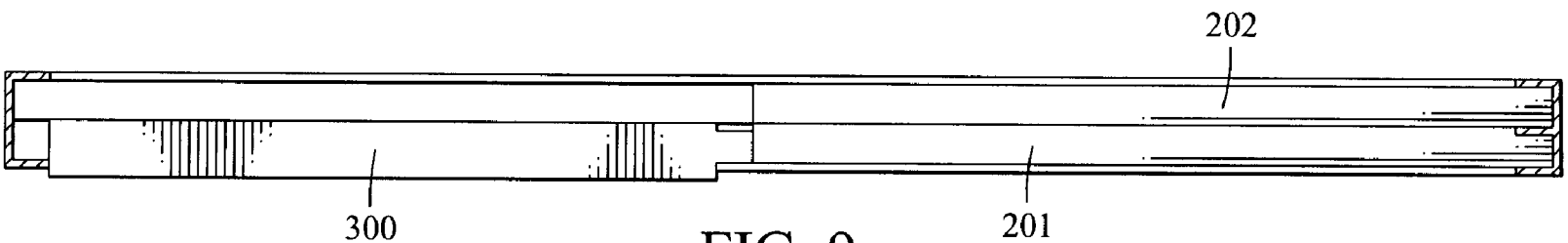
FIG. 9 is a top diagrammatic view similar to FIG. 8 showing the sliding door with the movable sash repositioned into an open position with the combined strut and threshold cover of FIG. 6 positioned within the door opening and being used as a threshold cover indicating the apparatus is a combined threshold cover and supplementary locking apparatus.

FIGS. 8 and 9 show that the distance from the left upright casement to the right outside of movable sash 201 is a longer distance than the door opening and the distance between shoulders 343 and the second end of the strut. This is commonly done to cause the sashes 201 and 202 to be even or nearly even as shown in FIG. 9 when the movable sash is open. It is also done so that when the movable sash is closed as shown in FIG. 8 the right upright of the movable sash 201 overlaps or is aligned with the left upright of the stationary or second sash 202.

Bottom Surface of Strut Apparatus

Figure 5:
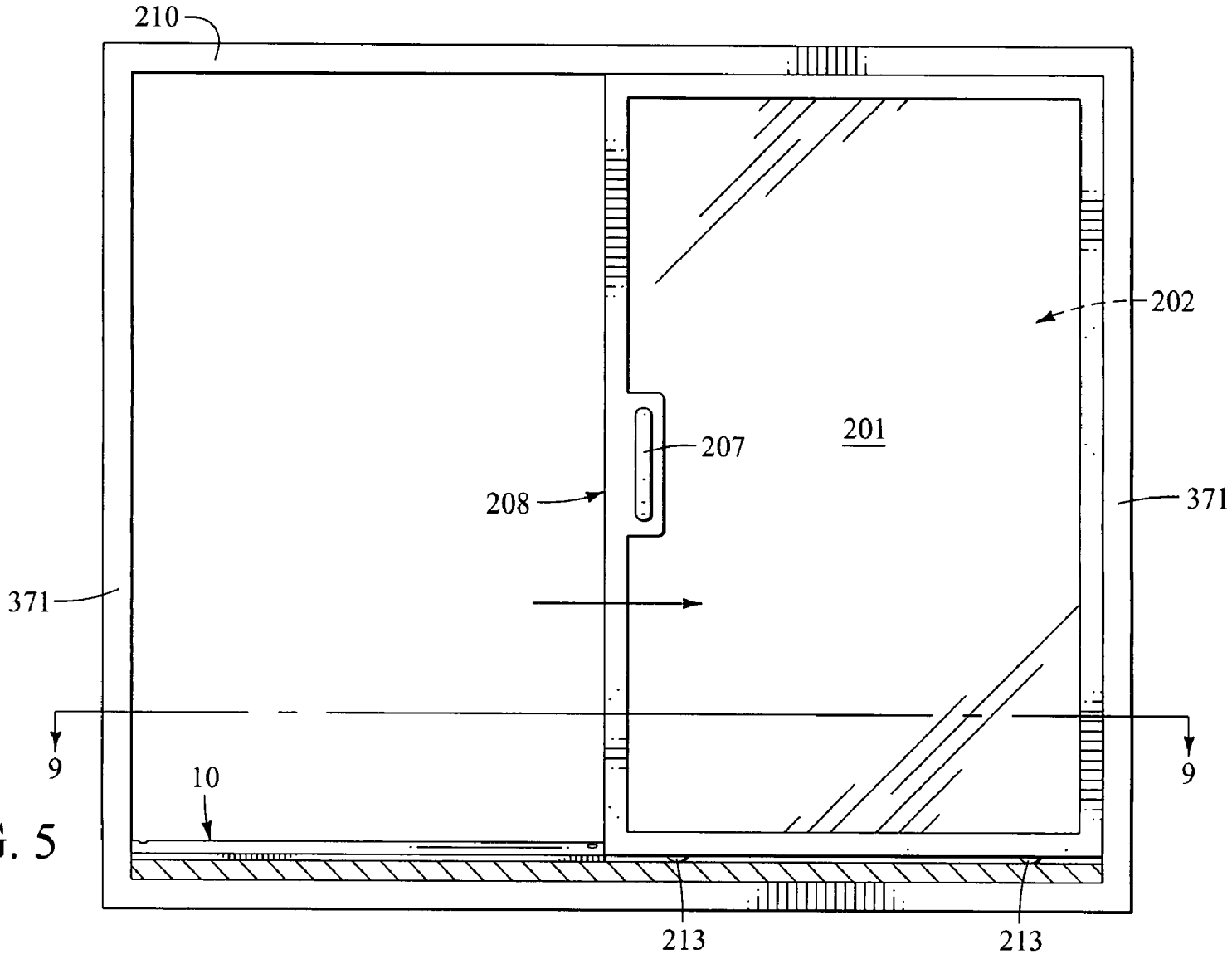
FIG. 5 is a front, interior elevational view similar to FIG. 2 with the moving door sash displaced toward the right and into juxtaposition with the second or stationary sash. The locking device of FIG. 1 is positioned in the sliding door opening.

FIG. 1 also shows that the bottom surface 13 preferably has a bottom surface groove or slot 20. The groove, slot or other guide rail receiver is sufficiently deep and wide to receive a guide rail 35 (FIG. 2) forming a part of the bottom guide of the casement framework 210 (FIG. 5). In the embodiment shown, the guide rail receiver is shaped as a triangular groove extending between opposing ends 17 and 18.

This preferred configuration has a first sloping receiver side 21 and a second sloping receiver side 22. The first and second receiver sides preferably intersect at an apex or other suitable juncture.

The bottom surface of strut 10 also preferably includes first and second bottom side portions along opposing sides of the guide rail receiver where such are used. In the embodiment shown, the bottom side portions are flat to sit flat upon the supporting casement frame 210 which has complementary surfaces on either side of the guide track which are also flat. If other casement frame bottom shapes or guide rail shapes are used in the sliding door, window or other closure, then the side portions of the bottom surface 13 may be differently and suitably shaped, such as in an alternative complementary shape different from that illustrated.

Casement Bottom Guide

In typical installations, frame 210 (FIG. 4) is provided with at least one guide rail or other feature along the upwardly facing bottom piece of the frame. The guide rail preferably includes a central guide rail.

It may alternatively be possible to provide the frame with a plurality of guide features, such as a plurality of guide rails similar to rail which are advantageously parallel. Other guide features may also be used if appropriately shaped and sized to engage with the bottom of the moving sash 201. If multiple guide rails are used then the strut 10 may have multiple receivers 20 or a single receiver sufficient to fit over the multiple rails.

Figure 4:
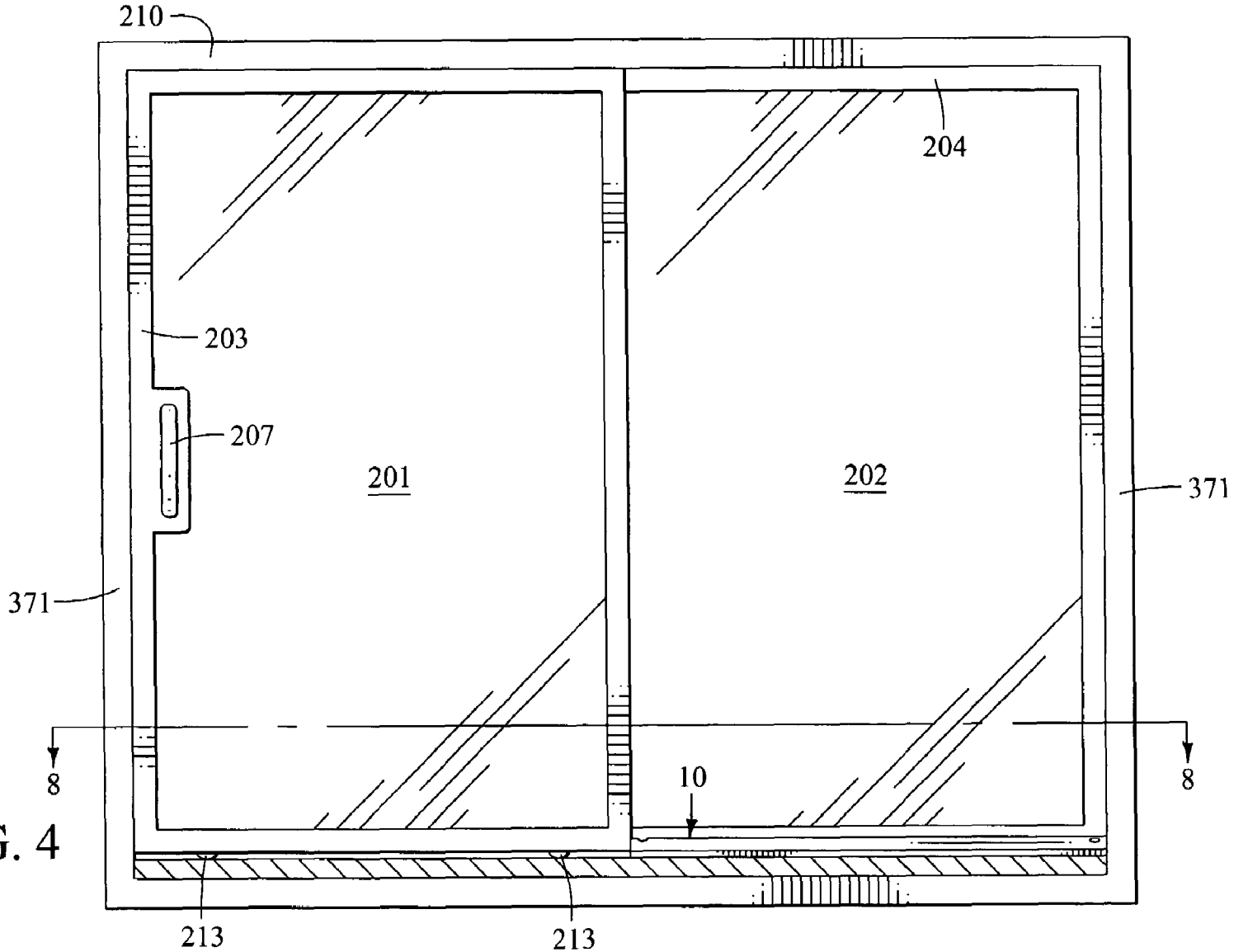
FIG. 4 is a front, interior elevational view of a sliding door assembly with the supplementary locking device of FIG. 1 installed in a locking position.

In some forms of door and window frames there are also lateral supports 132 (FIG. 3) which further support the sliding sash against displacement from the desired slide path of the slidable or moving sash 201 (FIG. 4).

A typical central guide rail 35, 135 is often used with a set of rollers 213 mounted upon the bottom of the moving or sliding sash 201. The guide rollers typically have concave outer peripheries (not shown) which roll upon the guide rail to facilitate movement along with the sliding action that occurs with the sash and associated guide. The guide rail or rails also serve to keep the sliding or rolling sash in alignment upon the frame bottom guide.

The guide rollers typically used on the sliding sashes are spring loaded. This spring loaded mounting of the guide rollers makes the sliding sash easier to move but more susceptible to displacement and entry by a burglar.

Casement Uprights

FIG. 8 shows that the casement framework may include uprights 371 at each end. The uprights typically have two channels, one for receiving the second or stationary sash right side upright. The other channel 372 is aligned with the guide channel along which the movable sash 201 moves. Depending upon brand of door the right upright sash may fit into the casement channel 372 when the movable sash 201 is fully open (see FIG. 9). This receiving relationship is not necessary in all implementations of this invention.

Third Embodiment Apparatus

Figure 6:
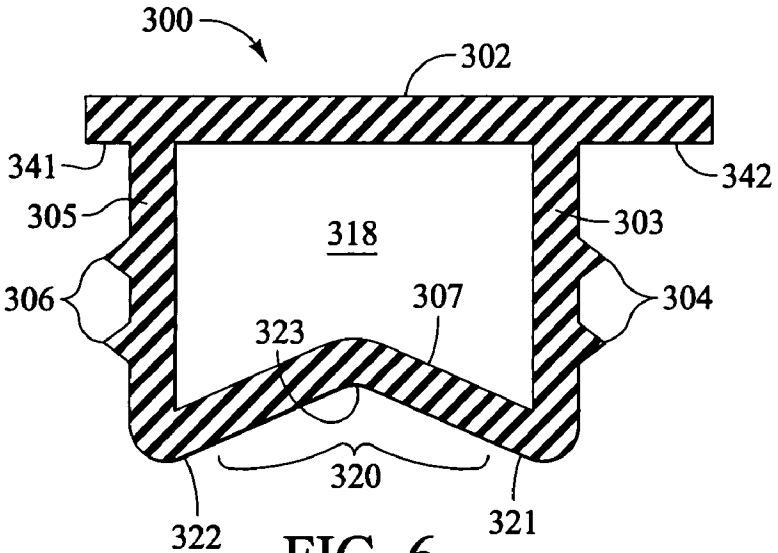
FIG. 6 is a cross-sectional view showing a third embodiment security apparatus according to this invention taken along section line 6-6 of FIG. 8 with portions of the third embodiment shown in isolation.
Figure 7:
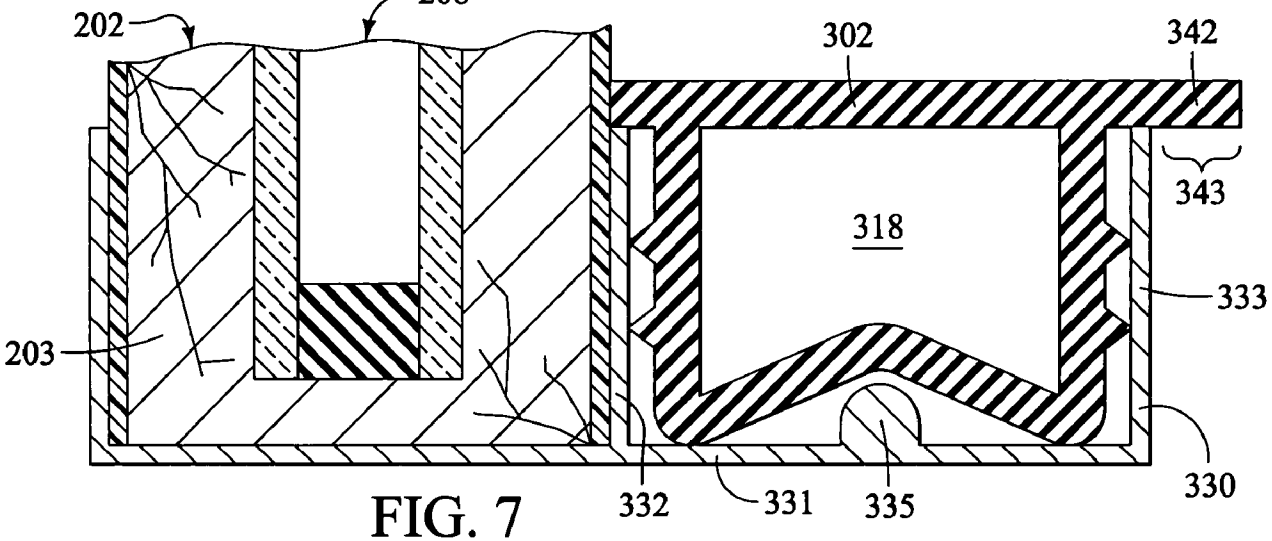
FIG. 7 is a cross-sectional view showing the third embodiment security apparatus of FIG. 6 positioned within a sash guide and the stationary sash is to the left and includes the third embodiment shown with section of the third embodiment taken along section line 6-6 of FIG. 8 with the sashes shown.

FIGS. 6 and 7 show a third embodiment according to the invention. The third embodiment apparatus 300 has a top wall 302, first side wall 303, and second side wall 305. It further has a bottom wall 307 which is preferably provided with a receiver 320 which receives the guide rail 335 when the apparatus is installed in the guide 330.

The side walls 303 and 305 of this form of the inventions are preferably provided with one or more sealing, engagement and guide channel retaining features; which is or are advantageously in the form of projections 304 and 306. Projections 304 and 306 may be constructed according to one form of the invention in the form of at least one and preferably plural projections that extend along the length of the sides. The projections advantageously come to a point or sealing edge to better engage the inside of the guide channel and thus help retain the security apparatus therein.

The material used to form the projections is desirably of a type that has some degree of elastomeric response capability. This allows the sealing projections to slightly distort and apply elastic force along a line of contact that tends to retail and can act to seal with the guide channel.

The apparatus 300 also has a first flange 341 that extends most of the length of the apparatus and is desirably configured to rest on top of a central web 332 of the guide channel.

The central web applies where the guide channel has an adjacent channel that is used to mount the stationary sash assembly 202.

Apparatus 300 also has a second or inside flange 342 which is on the opposite side of the top 302. Flange 342 extends a sufficient distance so as to cover the top of the guide channel side wall 333. More preferably, the second flange 342 extends beyond the channel side wall 333 about ⅛ inch to ½ inch, even more preferably about 3/16 to ⅝ inch beyond the side wall.

The cantilever or overhang 343 may also serve as one preferred form of handling feature. It can serve as a hold to which a person can apply one or both hands since it extends nearly the full length of the strut apparatus.

The security strut and threshold cover apparatus 300 has one or more cutouts similar to cutouts 29 shown in the strut 10 of FIG. 1 to allow extension into or insertion of the first end into the casement frame as explained elsewhere herein.

FIG. 7 shows a diagrammatical cross-section view which cuts through the middle or central upright of the stationary sash 202 and shows the threshold placement of the security apparatus. As shown, a piece of thermal double pane glass 208 is shown mounted in the sash frame 203 of stationary sash 202. In the door opening when the apparatus 300 is moved into the threshold mode of use, the sash 202 is not present and the channel may either , be present or the outside sidewall may be removed to reduce the tripping hazard. The apparatus 300 prevents dirt, mud water and other debris from easily entering the channel 330 in which apparatus 300 is inserted.

FIGS. 6 and 7 further show that the guide rail receiver 320 is shaped to be positioned over the guide track 335 at apex 323 using tapered bottom wall sections 322 and 323 of bottom wall 307. An interior cavity 318 is within the apparatus walls, top and bottom to reduce materials costs and provide pliancy to various features of the combined security strut and threshold cover 300.

Methods and Operation Generally

In one aspect the methods according to this invention include selecting a strut device having at least one end diminished relative to the opposing end to allow insertion in the casement upright channel 372. Such selecting is done to allow the opening size or configuration of the casement upright to receive the smaller first end 18 of the strut. Examples of such selecting includes a strut with notches or recesses 19. Other configurations can also be selected.

The preferred methods also include selecting a strut apparatus having a different size or configuration at the opposite second end 17. In the embodiment of FIG. 9 the diagram shows that the second, larger end of the strut apparatus does not fit within the left casement upright. This allows the typically different lengths to be easily accommodated in the open or closed positions. In the open position the distance across the closure opening in the open position, between the movable sash 201 upright and left casement frame is used but without insertion of the strut thereinto. This is in contrast to when the moveable sash is moved into the closed position, and the distance between the right movable sash frame and the casement frame upright 372 is the pertinent distance. For convenience these may be referred to as the open position distance and the closed position distance.

The preferred methods may perform by positioning the first end of the strut into the channel 372 of the right casement frame upright channel. This may entail an inserting step of the strut into the channel.

The methods may further perform by positioning a relatively larger or differently configured second end of the strut 300 (or other struts) to stop against the right sash frame upright 203 to act as a strut by maintaining the sash in the supplementary locked position shown in FIG. 8.

Methods according to the invention also may advantageously include engaging the strut 300 while in the locking position by using or manipulating one or more of the holds or handles described hereinabove.

The methods may further include holding the strut and forcing the strut in a manner which causes withdrawal or removal of the strut. This may involve tipping the strut at an angle relative to horizontal to shorten the effective horizontal length and thereby allowing the first end smaller section or projection to withdraw from the channel of the casement frame.

The holding actions may also include inserting fingers or a tool into apertures, such as apertures 41, 42, 141 and 142, or they may involve . grasping the outer overhanging lip or lips 19 or 119. This may be done at various points along the overhanging lip 119 or equivalent structure.

Methods according to the invention may also include moving the strut apparatus from the locking position.

The methods may further include moving the sliding closure from the closed postion to a fully or nearly fully open position. Thereafter the described strut apparatuses may be handled or manipulated into the opening now formed by the sliding closure.

The methods then involve positioning or placing the strut apparatuses so the enlarged or properly configured second end bears against the outer portions of the casement frame.

Further, the methods may include positioning the first end into a position engaging the left side of the moving sash as shown in FIG. 9.

The preferred methods also involve inserting the strut apparatus into the guide channel when the movable sash has been placed into the open position. This is best done by depressing the strut and causing the strut to be engaged with the guide channel in a manner that helps to retain the strut apparatus therein. The retaining may be accomplished by engaging longitudinal ribs against the guide channel of the closure opening. The inserting is preferably done so as to cause a positioning of the top surface of the strut apparatus to be only a small measurement above the typical height. This helps to prevent inadvertent tripping.

The methods may further include excluding dirt and/or debris from the open closure bottom guide channel by covering and protecting the channel from entry of any of a number of various undesired materials. Also tends to prevent using the bottom guide channel as some type of shoe clearing edge.

Along with the excluding step the novel strut apparatuses according to this invention are being acted upon by storing or stowing the strut apparatus in a place which is convenient, not noticeable, and does not require the strut to lean against a wall or some other storage situation.

Further methods according hereto may involve removing or extracting the strut apparatus from the position in the closure opening. This is done in preparation for closing the door or other closure. The methods may also include reinstalling the strut appratus as described fully above into the space between the moving sash and right casement upright as shown in FIGS. 8 and 9.

Interpretation Note

The invention has been described in language directed to the current embodiments shown and described with regard to various structural and methodological features. The scope of protection as defined by the claims is not intended to be necessarily limited to the specific features shown and described. Other forms and equivalents for implementing the inventions can be made without departing from the scope of concepts properly protected hereby.

I claim:

1. An apparatus for use with a sliding sash closure which moves upon a casement frame in which the sliding sash closure can be moved in a sliding action, said casement frame having a sash bottom guide channel within which the sliding sash closure move and having at least one guide rail with said sash bottom guide channel, comprising:

said apparatus having an elongated longitudinal shape;

a top wall forming part of said apparatus, said top wall having a top surface which is smooth to prevent dirt and debris from being caught thereon and reduce risk of catching things when the apparatus is used in the casement bottom guide channel and the sliding sash closure is in an open position;

a first side wall which is connected to the top wall, said first side wall having a first side wall surface which is oriented to taper inwardly toward a center of the top wall;

a second side wall which is connected to the top wall, said second side wall having a second side wall surface which is oriented to taper inwardly toward said is center of the top wall;

a first flange connected to the top wall and extending outwardly from said first side wall;

a second flange connected to the top wall and extending outwardly from said first side wall, said second flange being;

a bottom wall extending between lower edges of the first and second side wall;

at least one receiver extending upwardly as part of said bottom wall to receive said at least one guide rail therein;

whereby the apparatus may serve as both a locking strut when the siding sash closure is in a closed position, and as a threshold cover over the casement bottom guide channel when the sliding sash closure is in an open position.

2. An apparatus according to claim 1 wherein the first flange and second flange are of different widths.

3. An apparatus according to claim 1 wherein the top surface is arched.

4. An apparatus according to claim 1 wherein the at least one receiver is triangular in cross-sectional shape.

5. An apparatus according to claim 1 wherein opposing ends of the apparatus are shaped differently to allow at least one end to engage with a casement upright having recess therein.

6. An apparatus according to claim 1 further comprising handling features which are receptacles in the apparatus near ends of the elongated longitudinal shape.

* * * * *